United States Patent [19]

Scarpini

[11] Patent Number: 4,495,679

[45] Date of Patent: Jan. 29, 1985

[54] SLIDE-FASTENER HALF AND METHOD OF MAKING SAME

[75] Inventor: Manuela Scarpini, Milan, Italy

[73] Assignee: Interbrev S.A., Luxembourg, Luxembourg

[21] Appl. No.: 383,127

[22] Filed: May 28, 1982

[30] Foreign Application Priority Data

May 30, 1981 [CH] Switzerland ..... 3521/81

[51] Int. Cl.[3] ..... A44B 19/06

[52] U.S. Cl. ..... 24/414; 24/403; 24/413

[58] Field of Search ..... 24/408, 413, 414, 403

[56] References Cited

U.S. PATENT DOCUMENTS

| | | | |
|---|---|---|---|
| 1,859,572 | 5/1932 | Poux | 24/408 |
| 2,074,624 | 3/1937 | Schweinburg et al. | 24/413 |
| 2,268,571 | 1/1942 | Corner | 24/414 X |
| 2,353,106 | 7/1944 | Winterhalter | 24/413 |
| 2,496,946 | 2/1950 | Legat | 24/413 |
| 3,055,069 | 9/1962 | Morin | 24/413 |
| 3,735,454 | 5/1973 | Goldstein | 24/414 |

*Primary Examiner*—Francis K. Zugel
*Assistant Examiner*—Peter A. Aschenbrenner
*Attorney, Agent, or Firm*—Karl F. Ross; Herbert Dubno

[57] ABSTRACT

In order to ensure a firm bond between a row of coupling elements of a slide-fastener half and a stringer tape provided at a longitudinal edge with a carrier cord around which these elements are molded, the cord is compressed during the molding operation between jaws of two mold halves imparting to the engaged cord portion a generally triangular cross-section with rounded corners, the base of the triangle adjoining the stringer tape to define a pair of transverse shoulders embraced with positive fit by complementary tail sections of the coupling elements.

8 Claims, 8 Drawing Figures

PRIOR ART

SLIDE-FASTENER HALF AND METHOD OF MAKING SAME

FIELD OF THE INVENTION

My present invention relates to a slide-fastener half of the type wherein a row of coupling elements of polymeric (usually thermoplastic) material have heads interfitting those of similar coupling elements of a mating slide-fastener half and have tails molded around a carrier cord which is secured to a longitudinal edge of a stringer tape. My invention also relates to a method of making such a fastener half.

BACKGROUND OF THE INVENTION

In order to anchor the coupling elements to the stringer tape and to prevent their detachment in response to transverse tensions acting upon the closed fastener, it is known to deform portions of the carrier cord—whose diameter substantially exceeds the thickness of the adjoining stringer tape—between jaws of two mold halves in whose cavities the coupling elements are being formed. According to the usual practice, this deformation occurs between shallow depressions of the jaws which in the closed positions of the mold define a generally rectangular recess whose length in the parting plane of the mold halves approximately equals the original cord diameter while its width transverse to that plane is a fraction of that diameter. Such a dimensioning is designed to compress the fibers of the cord in the immediate vicinity of each coupling element, thereby increasing the density and thus the shear resistance of the cord portion embraced by that element for a firmer connection of the latter with the tape. This densification, on the other hand, greatly reduces the extent by which the cord projects from the stringer tape so that even a moderate tension perpendicular to the tape edge, such as that exerted by a slider during closure of the fastener, can detach a coupling element from the cord and thereby from the tape itself.

In my copending application Ser. No. 247,642, filed Mar. 26, 1981 and now U.S. Pat. No. 4,458,391, I have disclosed a method of improving the bond between a molded coupling element and a woven stringer tape by providing the latter with a limited number of thermoplastic warp threads adjoining the carrier cord, these warp threads being interlockingly engaged by and fused to the coupling elements. The carrier cord, secured to the stringer tape by its weft threads, is thus partly relieved of the task of holding the coupling elements in place.

OBJECT OF THE INVENTION

The object of my present invention is to provide an improved slide-fastener half in which the problem of more securely anchoring the coupling elements to a stringer tape is solved without the need for any special warp threads, along with a convenient method of making such a fastener half.

SUMMARY OF THE INVENTION

Pursuant to my present invention, the recesses jointly defined by the jaws of the mold halves in a position of mold closure are of generally triangular profile converging in a direction away from a marginal zone of the stringer tape bracketed by the tail section of each coupling element, these recesses imparting to the engaged cord portions a corresponding cross-sectional configuration with shoulders projecting substantially perpendicularly from opposite surfaces of the stringer tape in the immediate vicinity of each coupling element and within the coupling element itself.

More particularly, each recess profile advantageously approximates an isosceles triangle with rounded corners and with a base transverse to the parting plane of the mold halves. The triangle may have an apex angle, opposite its base, ranging between 45° and 60°. The length of the base may thus be made more or less equal to the original cord diameter even though the cross-sectional area of the engaged cord portions is substantially less than that of the uncompressed cord so that the desired densification is achieved.

BRIEF DESCRIPTION OF THE DRAWING

The above and other features of my present invention will now be described in detail with reference to the accompanying drawing in which:

FIG. 13 is a cross-sectional view of the conventional fastener, taken on the line III—III of FIG. 2;

SPECIFIC DESCRIPTION

Figure 1A:
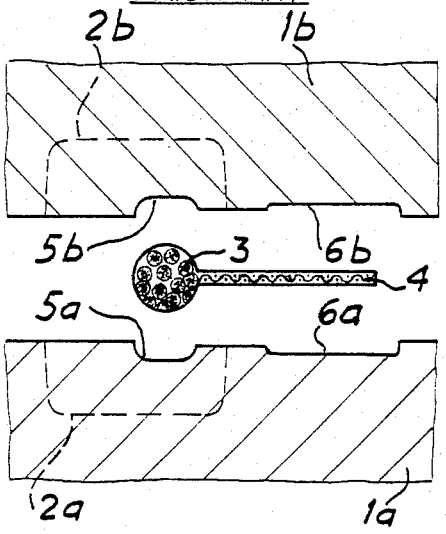
Fig. 1A PRIOR ART
FIGS. 1A and 1B are cross-sectional views of part of a conventional mold, respectively shown in open and closed position, for the molding of coupling elements about a carrier cord and an adjoining zone of a stringer tape.
Figure 1B:
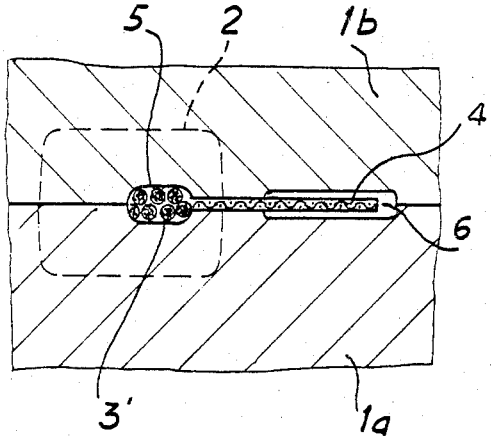
Fig. 1B PRIOR ART
Figure 3:
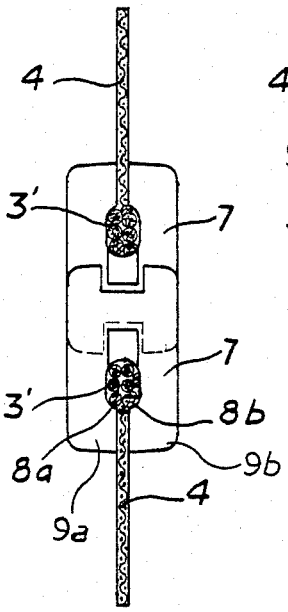
Fig. 3 PRIOR ART
Figure 2:
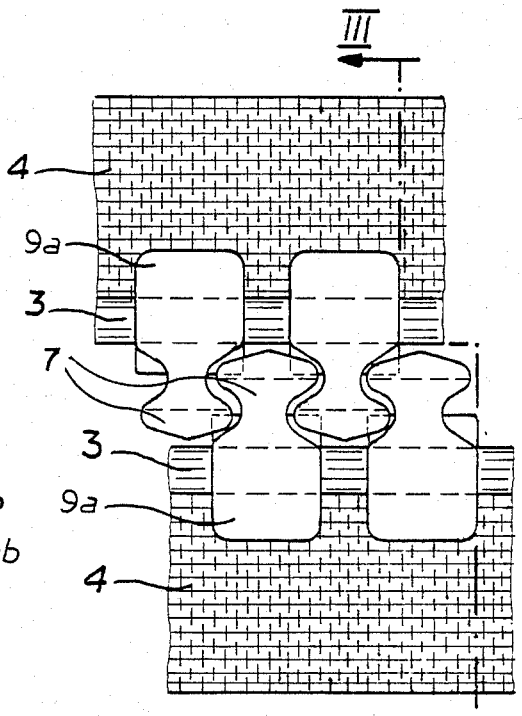
FIG. 2 is a plan view of part of a conventional slide fastener with halves formed in the mold of FIGS. 1A and 1B.

In FIGS. 1A and 1B I have shown a known type of mold with halves 1*a* and 1*b* having cavities 2*a* and 2*b* for the production of coupling elements 7 of a slide-fastener half as seen in FIGS. 2 and 3, these cavities having lateral walls with shallow depressions 5*a*, 5*b* and 6*a*, 6*b*. In the closed-mold position shown in FIG. 1B, depressions 5*a* and 5*b* seen in FIG. 1A form a recess 5 of generally rectangular profile serving to compress an engaged portion 3′ of a carrier cord 3 into a corresponding cross-sectional shape. This cord 3 is firmly attached to an adjoining stringer tape 4 which is partly clamped between jaws formed by the recessed mold portions; a rear part of the tape remains free within a recess 6 formed by the depressions 6*a*, 6*b* of mold halves 1*a*, 1*b*. In the closure position of FIG. 1B, the two cavities 2*a* and 2*b* of these mold halves constitute a space 2 which conforms to the shape of a coupling element 7 to be molded and which is traversed by a part of cord 3 lying between its compressed portions 3′ whose generally rectangular configuration extends more or less into that intervening part. The molded coupling elements 7, FIGS. 2 and 3, having tail sections 9*a*, 9*b* closing about a marginal zone of tape 4 adjoining the cord 3 whose compressed portions 3′ form shoulders 8*a*, 8*b* interlocking with these tail sections. With cords of the usual diameter only a few times as large as the tape thickness, however, these shoulders 8*a* and 8*b* project but slightly from the surfaces of tape 4 as clearly shown in FIG. 3.

Figure 4A:
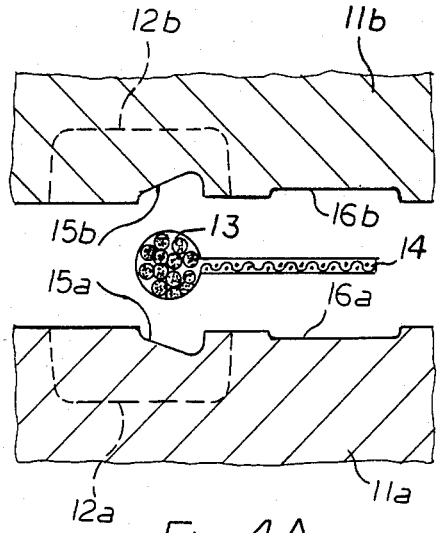
FIGS. 4A and 4B are views analogous to those of FIGS. 1A and 1B but relating to a mold for practicing my improved manufacturing method.
Figure 4B:
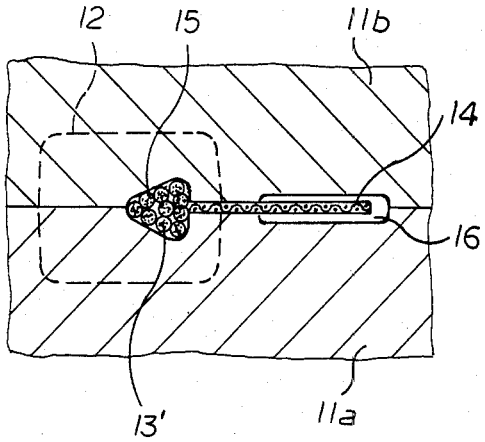

FIGS. 4A and 4B illustrate two modified mold halves 11*a* and 11*b* with cavities 12*a* and 12*b* having lateral walls with sloping depressions 15*a*, 15*b* which, in the closure position of FIG. 4B, define a recess 15 whose profile is an isosceles triangle with rounded corners. When the mold is closed, a stringer tape 14 is partly received in a recess 16 formed by shallow depressions 16*a* and 16*b* of mold halves 11*a* and 11*b* seen in FIG. 4A. The tape 14 is firmly connected (e.g. through weft threads) with a carrier cord 13 which is substantially identical with cord 3 of FIG. 1A prior to its partial deformation between the recesses jaws of the two mold halves. The compressed cord portions 13' have a generally triangular cross-section corresponding to the profile of recess 15 which also extends into the unclamped part of the cord traversing a mold space 12 constituted by the cavities 12*a* and 12*b*.

Figure 6:
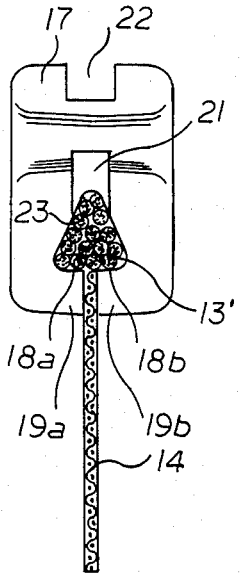
FIG. 6 is a cross-sectional view taken on the line VI—VI of FIG. 5.
Figure 5:
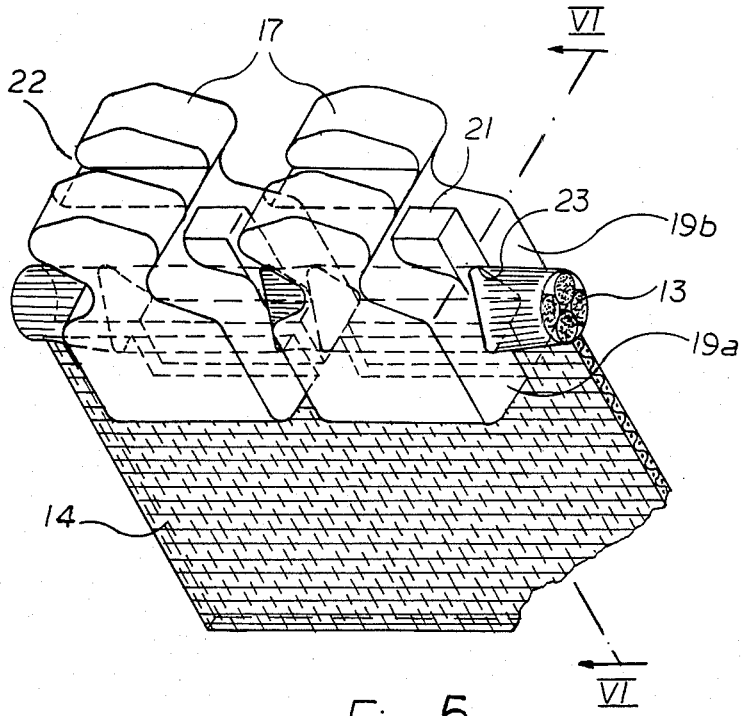
FIG. 5 is a perspective view of part of a slide-fastener half according to my invention, made with the mold of FIGS. 4A and 4B.

As will be apparent from FIGS. 4B and 6, the isosceles triangle corresponding to the cross-sectional area of each compressed cord portion 13' has a base of a length closely equaling the diameter of the uncompressed cord 13, a height also approximating that diameter, and a vertex pointing away from tape 14 with an apex angle between about 45° and 60°. Coupling elements 17 (FIGS. 5 and 6) formed in the mold of FIGS. 4A and 4B have tail sections 19*a*, 19*c* interlocking engaging shoulders 18*a* 18*b* defined by the base of the aforementioned triangle, the height of these shoulders considerably exceeding that of the shoulders 8*a* and 8*b* seen in FIG. 3. Lateral ribs 21 of coupling elements 17, fitting into recesses 22 of the heads of identical coupling elements on a slide-fastener half mating with that of FIG. 5, have generally V-shaped rearwardly facing cutouts 23 receiving the convergent front edges of the deformed cord portions 13'. Thus, the several coupling elements 17 engage the cord 13 with a firm positive fit preventing their detachment from tape 14 even in the presence of strong tensile forces.

I claim:

1. A method of making a slide-fastener half, comprising the steps of:

(a) providing a stringer tape with a carrier cord attached to a longitudinal edge thereof, said carrier cord being of generally circular cross-section with a diameter substantially exceeding the thickness of said stringer tape;

(b) clamping said stringer tape and said carrier cord between jaws of two mold halves defining recesses of generally triangular profile on opposite sides of a plurality of cavities, with closure of said jaws about said carrier cord and resulting deformation of the latter into spaced-apart portions of corresponding generally triangular configuration having bases perpendicular to said stringer tape at said longitudinal edge and vertices pointing away from said stringer tape, the deformation extending into unclamped parts of said carrier cord lying within said cavities; and (c) molding coupling elements in said cavities with tail sections embracing said unclamped parts and an adjacent marginal zone of said stringer tape and with heads projecting beyond said carrier cord for interfitting with heads of similar coupling elements of another slide-fastener half, said deformation producing shoulders extending transversely from opposite surfaces of said stringer tape into positive engagement with the coupling elements molded therearound.

2. The method defined in claim 1 wherein said recesses have profiles approximating isosceles triangles with rounded corners and with bases bisected by a parting plane of said mold halves.

3. The method defined in claim 2 wherein said triangles have apex angles opposite said bases ranging between substantially 45° and 60°.

4. The method defined in claim 2 wherein said base is given a length substantially equaling the diameter of the uncompressed cord.

5. A slide-fastener half comprising:

a stringer tape anchored to a carrier cord adjacent a longitudinal edge thereof, said carrier cord having a generally circular cross-section with a diameter substantially exceeding the thickness of said stringer tape; and a row of spaced-apart coupling elements of polymeric material with tails molded about said carrier cord and an adjacent marginal zone of said stringer tape and with heads projecting beyond said longitudinal edge, said carrier cord being provided between said coupling elements with densified portions having a generally triangular cross-section converging in a direction away from said marginal zone and forming shoulders projecting substantially perpendicularly from opposite surfaces of said stringer tape at a junction of said stringer tape with said carrier cord, said densified portions extending into said coupling elements for engagement of said shoulders with positive fit by said tails for firmly anchoring said coupling elements to said stringer tape.

6. A slide-fastener half as defined in claim 5 wherein said cross-section approximates an isosceles triangle with rounded corners and with a base defining said shoulders.

7. A slide-fastener half as defined in claim 6 wherein said triangle has an apex angle remote from said base ranging between substantially 45° and 60°.

8. A slide-fastener half as defined in claim 5, 6 or 7 wherein said coupling elements have lateral ribs flanking said heads in the plane of said stringer tape and fitting into complementary grooves of interleaved heads of coupling elements on a mating slide-fastener half, said cross-sections converging within rearwardly facing complementary cutouts of said ribs.

* * * * *